US008555980B1

(12) United States Patent
Powell

(10) Patent No.: US 8,555,980 B1
(45) Date of Patent: Oct. 15, 2013

(54) OIL WELL BLOWOUT CONTAINMENT DEVICE

(76) Inventor: John Powell, Santa Clarita, CA (US)

( * ) Notice: Subject to any disclaimer, the term of this patent is extended or adjusted under 35 U.S.C. 154(b) by 157 days.

(21) Appl. No.: 13/157,171

(22) Filed: Jun. 9, 2011

Related U.S. Application Data

(60) Provisional application No. 61/380,178, filed on Sep. 3, 2010, provisional application No. 61/353,064, filed on Jun. 9, 2010.

(51) Int. Cl.
*E21B 43/01* (2006.01)

(52) U.S. Cl.
USPC ..... 166/363; 166/79.1; 166/97.1; 166/75.13; 285/302; 251/212

(58) Field of Classification Search
USPC ..... 166/335, 339, 345, 352, 356, 359, 363, 166/364, 367–369, 379, 380, 79.1, 81.1, 166/97.1, 75.13, 93.1; 138/155; 285/145.1, 285/302; 169/69; 251/212
See application file for complete search history.

(56) References Cited

U.S. PATENT DOCUMENTS 1,858,241 A * 5/1932 Giles ..... 166/95.1
2,649,272 A * 8/1953 Barbato ..... 251/212
3,389,559 A * 6/1968 Logan ..... 405/60
3,548,605 A * 12/1970 Armistead et al. ..... 405/60
3,561,220 A * 2/1971 Riester ..... 405/60
3,653,215 A * 4/1972 Crucet ..... 405/60
3,658,181 A * 4/1972 Blair ..... 210/170.05
3,664,136 A * 5/1972 Laval et al. ..... 405/60
3,666,100 A * 5/1972 Madej ..... 210/800
3,667,605 A * 6/1972 Zielinski ..... 210/170.11
3,674,150 A * 7/1972 Lejeune ..... 210/245
3,681,923 A * 8/1972 Hyde ..... 405/60
3,724,662 A * 4/1973 Ortiz ..... 405/65
3,745,773 A * 7/1973 Cunningham ..... 405/60
3,981,154 A * 9/1976 Hix, Jr. ..... 405/60
4,290,714 A * 9/1981 Strange ..... 405/60
4,318,442 A * 3/1982 Lunde et al. ..... 166/357
4,323,118 A * 4/1982 Bergmann ..... 166/96.1
4,324,505 A * 4/1982 Hammett ..... 405/60
4,358,218 A * 11/1982 Graham ..... 405/60
4,358,219 A * 11/1982 Burns ..... 405/60
4,382,716 A * 5/1983 Miller ..... 405/60
4,395,157 A * 7/1983 Cunningham ..... 405/60
4,416,565 A * 11/1983 Ostlund ..... 210/170.11
4,421,436 A * 12/1983 Burns ..... 405/223.1
4,440,523 A * 4/1984 Milgram et al. ..... 210/170.11
4,449,850 A * 5/1984 Cessou et al. ..... 405/60
4,456,071 A * 6/1984 Milgram ..... 166/356
4,531,860 A * 7/1985 Barnett ..... 405/60
4,568,220 A * 2/1986 Hickey ..... 405/60
4,643,612 A * 2/1987 Bergeron ..... 405/60
4,702,832 A * 10/1987 Renfrow ..... 210/242.3
4,790,936 A * 12/1988 Renfrow ..... 210/242.3
4,858,882 A * 8/1989 Beard et al. ..... 251/1.2

(Continued)

*Primary Examiner* — Matthew Buck
(74) *Attorney, Agent, or Firm* — Kenneth L. Green

(57) ABSTRACT

A blowout containment system is permanently positioned on the wellhead. The blowout containment system is relatively inexpensive, is always available and in place, it does not interfere with normal drilling operations, will capture all of the oil and gas emitted by the blowout, does not require special or unique sea surface or underwater apparatus or vessels, does not have any operational requirements that are different than those which drilling crews normally use and are already familiar, and is activated the using actions are similar to those used by drilling crews for well drilling and completion.

16 Claims, 3 Drawing Sheets

(56) References Cited

U.S. PATENT DOCUMENTS

| | | | | | |
|---|---|---|---|---|---|
| 4,949,785 | A | * | 8/1990 | Beard et al. | 166/84.4 |
| 5,116,017 | A | * | 5/1992 | Granger et al. | 251/1.2 |
| 5,213,444 | A | * | 5/1993 | Henning | 405/63 |
| 5,284,213 | A | * | 2/1994 | Nobileau | 175/5 |
| 5,484,024 | A | * | 1/1996 | Ladd et al. | 166/369 |
| 5,588,491 | A | * | 12/1996 | Brugman et al. | 166/383 |
| 5,662,171 | A | * | 9/1997 | Brugman et al. | 166/383 |
| 6,375,155 | B1 | * | 4/2002 | Janssens | 251/212 |
| 7,987,903 | B1 | * | 8/2011 | Prado Garcia | 166/75.13 |
| 8,016,030 | B1 | * | 9/2011 | Prado Garcia | 166/75.13 |
| 8,215,613 | B2 | * | 7/2012 | Cheung | 251/212 |
| 2011/0274493 | A1 | * | 11/2011 | Cutts | 405/60 |
| 2011/0274496 | A1 | * | 11/2011 | Dvorak | 405/64 |
| 2011/0293372 | A1 | * | 12/2011 | Later | 405/60 |
| 2011/0297396 | A1 | * | 12/2011 | Hendel et al. | 166/379 |

* cited by examiner

OIL WELL BLOWOUT CONTAINMENT DEVICE

The present application claims the priority of U.S. Provisional Patent Application Ser. No. 61/353,064 filed Jun. 9, 2010 and U.S. Provisional Patent Application Ser. No. 61/380,178 filed Sep. 3, 2010, which applications are incorporated in their entirety herein by reference.

BACKGROUND OF THE INVENTION

The present invention relates to deep water oil well leak containment and in particular to a well-head collapsible enclosure for capturing escaping oil from a deep water well-head leak.

Known devices to prevent uncontrolled release of oil into the ocean from underwater well blowouts fall into two categories: a) conical or umbrella-like structures that are lowered from a surface vessel over the blowout, and b) conical or dome-like structures that are permanently installed over the wellhead and that have some means of withdrawing collected oil and gas. None of these devices are permanently deployed in advance of a blowout.

These known approaches all have many disadvantages as evidenced by the fact that none of them are in use. Among the more serious drawbacks are difficult if not impossible tasks of positioning a conical, or other structure, over the venting oil and gas plume, failure to contain all or most of the oil, awkward deployment means which often requires specialized support equipment or vessels, obstruction of the wellhead, interference with normal drilling operations, a requirement that the containment apparatus be pre-positioned in a convenient location on land near the drill site or on the drilling platform, a long time delay between well blowout and spill containment, and the need for special training of crews for placement and or operation.

BRIEF SUMMARY OF THE INVENTION

The present invention addresses the above and other needs by providing a blowout containment system permanently positioned at the wellhead. The blowout containment system is relatively inexpensive, is always available and in place, it does not interfere with normal drilling operations, will capture all of the oil and gas emitted by the blowout, does not require special or unique sea surface or underwater apparatus or vessels, does not have any operational requirements that are different than those which drilling crews normally use and are already familiar with, and is activated the using actions are similar to those used by drilling crews for well drilling and completion.

In accordance with one aspect of the invention, there is provided a blowout containment system positioned at the wellhead of every undersea drilling site before drilling begins. If a blowout or significant leak occurs and the blowout preventer is unable to contain the escaping oil, with the present invention a means to capture the escaping oil will already be in place at the needed location. The only action required will be to connect loose ends of pre-connected cables to take-up reels aboard a vessel or the drill rig or with a remotely operated vehicle, and to connect relief lines to valves already located on a base cylinder through which the escaping oil and gas can be directed to a manifold and from there to a surface vessel or undersea pipeline. All of these operations are commonplace and routine activities for anyone versed in the art of undersea drilling.

In accordance with another aspect of the invention, there is provided an underwater oil well blowout containment device which comprises a set of telescoping steel cylinders attached at the bottom to a heavy steel anchor ring. At the top, the innermost cylinder or alternatively the outermost is attached to closing apparatus. During deployment and normal drilling operations the blowout containment device is collapsed leaving the entire center area of the wellhead free of obstructions.

In accordance with yet another aspect of the invention, there is provided closure apparatus comprising an iris valve or clamshell closure for closing the top of the blowout containment device. The Iris valve may be attached to the innermost cylinder of a telescoping cylindrical containment device, and the clamshell device to the outermost cylinder. The iris valve comprises a number of overlapping heavy steel blades which operate in unison to open or close the opening at the top of the blowout containment device, similar in concept to a camera iris. During deployment and normal drilling operations, the blades are swung completely open to a rest position over the collapsed blowout containment device in an annular configuration. The inner diameter of the open iris is approximately equal to the inner diameter of the innermost cylinder, leaving the entire center area free of obstructions.

In accordance with still another aspect of the invention, the collapsed height of the concentric cylinders is less than the height of the valves and fittings on the BlowOut Preventer (BOP) so that normal drilling operations are not hindered.

In accordance with another aspect of the invention, either the outer cylinder or the inner cylinder, which is rigidly attached to a heavy anchor ring base, is stationary. Additional cylinders are nested within the outer cylinder or outside the inner cylinder. All the additional cylinders are able to move upward when spill containment is required, and at full extension reach a height greater than the top of the BOP. In this configuration the cylinders form a steel wall surrounding the wellhead and BOP.

In accordance with still another aspect of the invention, lifting eyes are attached to the inner cylinder of the nested cylinders. Lifting cables may be connected to the eyes before or during deployment of the underwater oil well blowout containment device. Either a surface vessel or remotely operated underwater vehicles can deploy the blowout containment device by lifting the cylinders up by means of these eyes and or cables.

In accordance with yet another aspect of the invention, the individual blades of the iris valve may be ganged to operate in unison by means of a pair of rings at the periphery, one of which is stationary and contains blade pivot shafts. The other ring is movable, and contains a set of shafts or pins which slide in slots in the iris valve blades. These slots are positioned and configured so that when this ring is turned, the blades of the valve swing inward to the closed position.

In accordance with another aspect of the invention, the iris valve blades are canted downward, so that when the iris is closed, the iris forms a concave shape when viewed from the outside. This increases the pressure holding capability of the containment device.

In accordance with yet another aspect of the invention, the geometry of the iris blades is such that the top of the cylinder is completely closed when the blades are moved to the fully closed position, and closure around the drill pipe is obtained at the blades inner boundary. If the blowout incident caused the drill pipe to blow away, the blades will continue closing until complete closure is attained.

In accordance with another aspect of the invention, the fixed outer cylinder contains several valves with fittings which transit hoses or lines can be attached to by underwater Remotely Operated Vehicles (ROVs) or by other means to extract oil and gas from the inside of the cylinder. The lines can lead to a manifold which in normal drilling operations is already in place, and from there the oil and gas would be directed to surface tankers or to an undersea pipeline. The transit lines and manifold are part of the complement of apparatus normally associated with underwater drilling operations.

In accordance with yet another aspect of the invention, a containment device is provided which can withstand significant pressure, but is not a pressure vessel. In some instances, the pressure of the escaping oil and/or gas may exceed the capability of the containment device to contain the resulting pressure. To accommodate high pressure, two safety measures are incorporated, one in the operational procedure and one in the design. The procedure is to delay closing the iris valve until the oil/gas transit lines are in place and the valves open. In this way, and by adjusting the opening of the valves, adequate pressure is maintained within the device to force the oil through the pipe lines, but the pressure will never be able to increase to unacceptable levels. The design feature, which is a backup to the operational procedure, is pressure relief valves. In addition to the valves described above which direct the oil and gas to a manifold, several pressure relief valves are also included in the same cylinder. If the pressure inside the containment device is excessive due to blowout pressure fluctuations or operator error, the oil and gas will be vented to the ocean until the adverse situation is corrected and it is possible to divert the oil and/or gas to the manifold.

In accordance with another aspect of the invention, the blowout containment device is placed around the wellhead in advance the commencement of drilling. As a result, blowout containment device is available for immediate deployment to capture escaping oil and/or gas if a blowout or significant leak beneath the BOP occurs.

In accordance with yet another aspect of the invention, the blowout containment device is sufficiently well anchored to the sea bed and or the wellhead so as to not be displaced by the pressure of escaping oil and gas, or by currents or other disturbances.

In accordance with still another aspect of the invention, there is provided a blowout containment device which is deployed and anchored using the same techniques and equipment used to prepare the wellhead and deploy the BOP.

The present invention addresses all of the known issues and more. It is relatively inexpensive, it is always available and in place, it does not interfere with normal drilling operations, it will capture all of the oil and gas emitted by the blowout, it does not require special or unique sea surface apparatus or vessels, it does not have any operational requirements that are different than those with which drilling crews are familiar, and if it needs to be activated, the required actions are the same as those normally used for drilling operations.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

The world wide need for energy and the depletion of shore side reserves has driven oil drilling to ever deeper waters. Leaks or blowouts at any depth, even on land, can be very difficult to deal with, but the difficulty increases with increasing depth where drilling operations are at the leading edge of existing technology. The present invention is a blowout containment device for addressing subsea leaks.

The present invention includes telescoping steel cylinders that contain the flowing oil and gas, and direct it from ports through pipes to an existing manifold for transfer to tankers or undersea pipelines. Its function is to prevent oil and gas from venting into the ocean in the event of a failure of the BlowOut Preventer (BOP) or any apparatus or structure beneath the BOP.

Figure 1:
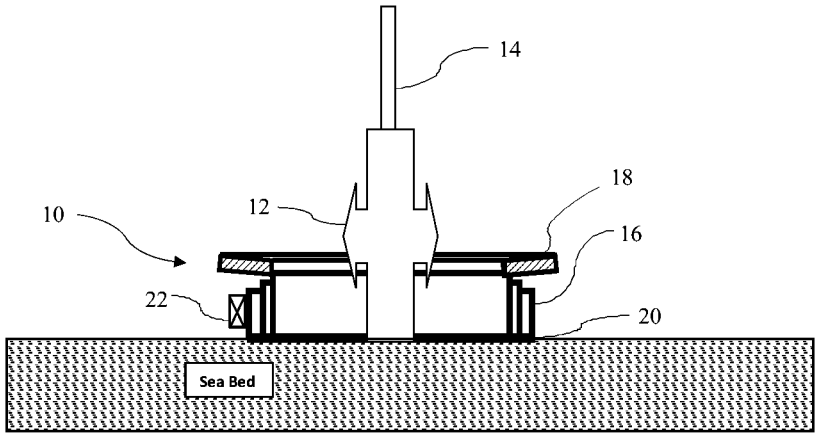
FIG. 1 is a side cut view of a blowout containment device in its rest configuration around the wellhead. The BOP is shown already in place. The blowout containment device is in its standby configuration, available for future use.

FIG. 1 is a side view cut-away of the blowout containment device 10 in position around wellhead apparatus including the blowout preventer 12 ("BOP") and the drill pipe 14. The device consists of a telescoping cylindrical steel housing 16 and a top closure 18. The cylindrical housing surrounds the wellhead and drilling apparatus including the BOP 12. The blowout containment device 10 is anchored to the sea bed by means of an anchor plate 20 which may be secured to the wellhead and or the sea bed. One of the several oil extraction ports and valves 22 is shown in FIG. 1. FIG. 1 and the others are intended to convey the concept and should not be construed as accurate from a design point of view. For example, there will most likely be more than three nested (or telescoping) cylinders 16, but only three are shown in FIG. 1 for clarity.

In FIG. 1 the steel cylinders 16 are fully collapsed and the top closure 18 is fully open. The vertical height of the collapsed device 12 is low enough that it will not prevent work on the valves, ports, and other access points on the BOP 12. The diameter of the inner most cylinder 16 is larger than the horizontal reach of the BOP 12 in its operating configuration with the bonnets closed. In this normal operating configuration, that is, with the cylinders 16 collapsed within one another, the blowout containment device 10 will not hamper opening the BOP bonnets if required during the well drilling process. The actual physical dimensions of the blowout containment device 10 vary with the size of the BOP 12.

Figure 2:
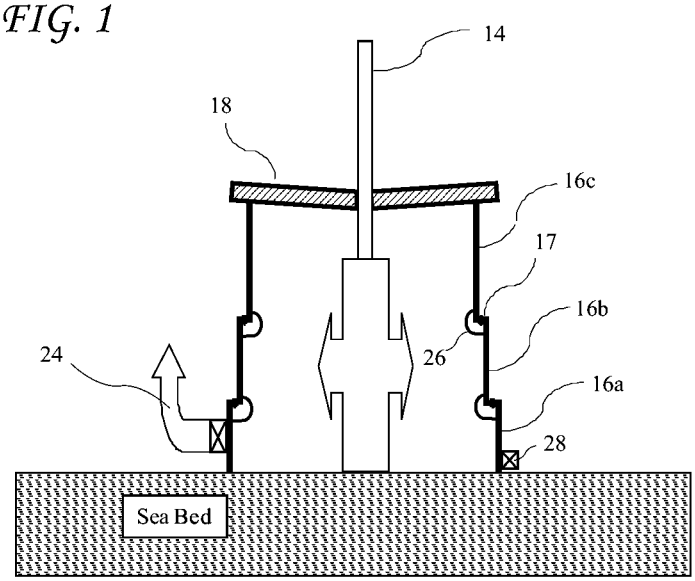
FIG. 2 is a side cut view of a blowout containment device deployed to contain oil and gas.

FIG. 2 is a side view cut-away of the blowout containment device 10 in its deployed configuration. The telescoping cylinders 16*a*, 16*b*, and 16*c* are fully extended and locked into position. The joints between pairs of cylinders are closed by seals 17. The various cylinders 16*a*, 16*b*, 16*c* are automatically fixed in this fully extended position by latches 26 that are automatically tripped when full vertical extension is reached. The top closure 18 is closed tightly around the drill pipe 14. Escaping oil and/or gas are thus contained within the volume defined by the cylinders 16*a*, 16*b*, and 16*c*, and the top closure 18. Pressure in excess of the design operating limit of the blowout containment device 10 is relieved in normal operation by the several outlet ports in the lower cylinder to which transfer pipes or tubes 24 are connected. The pipes 24 deliver the oil and/or gas to an existing manifold, typically present during drilling operations, and from there to surface vessels or an undersea pipe line.

Pressure surges or pressure buildup is relieved by one or more of the several pressure relief valves 28 also located around the periphery of the largest cylinder 16*a* at the base of the blowout containment device 10. In this over pressure condition oil and/or gas would be vented to the sea. However, attaching more pipes 24 or opening the valves 22 more fully will return the pressure relief valves to their seated position, once again directing all oil and gas to the manifold.

When the nested set of cylinders 16*a*, 16*b*, 16*c* is expanded vertically to the maximum design height, the top of the blowout containment device 10 is above the height of the BOP 12. With the latches engaged, this is a mechanically stable configuration.

Figure 3A:
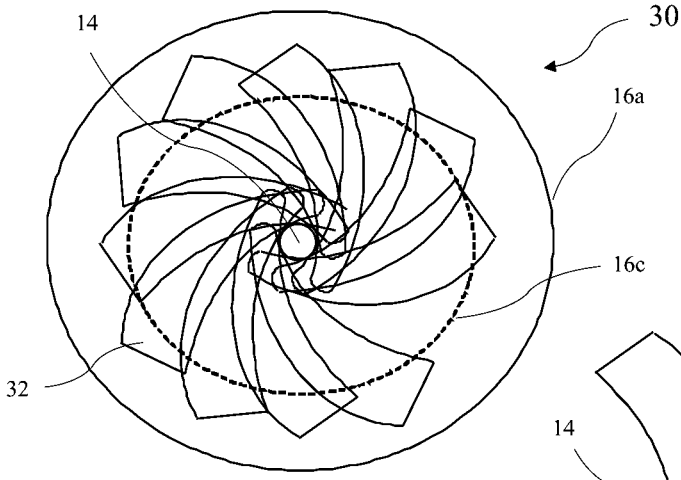
FIG. 3A is a top view of the blowout containment device with the iris valve closed.
Figure 3C:
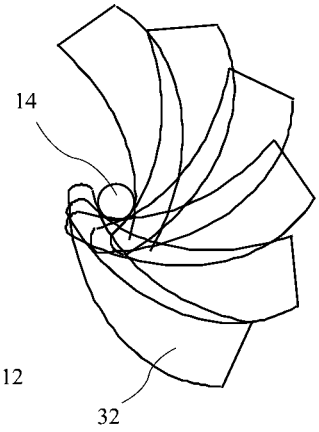
FIG. 3C is a top view illustrating how the blades of the iris valve close the top of the blowout containment device.
Figure 3B:
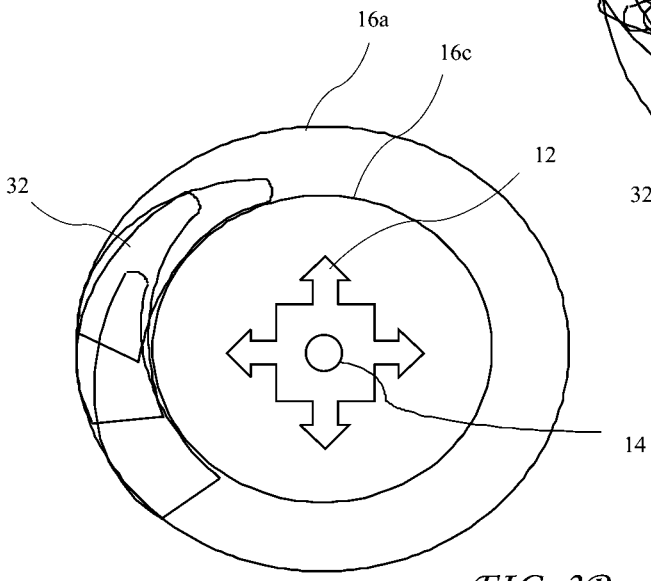
FIG. 3B is a top view of the blowout containment device with the iris valve open.

FIGS. 3A, 3B, and 3C are top views of a top closure 18 comprising an iris valve 30. FIG. 3A shows the iris valve 30 completely closed around the drill pipe 14. FIG. 3B shows the iris valve 30 completely open, leaving the BOP 12 and the drill pipe 14 clear of obstruction. FIG. 3C shows some of the blades 32 closed around the drill pipe 14.

The iris valve 30 is composed of a multitude of individual, overlapping steel blades 32, preferably eight to twenty in number, although the number may be greater or fewer and more preferably about twelve. When the blades 32 are in their fully open position as in FIG. 3C, the clear inner diameter is approximately equal to the inner diameter of the smallest of the steel cylinders 16*c*. When the blades are closed as in FIG. 3A, they can close the top of the cylindrical shell completely in the case where the drill pipe 14 is missing, or can seal around the outer diameter of the drill pipe 14 when it is present. The outer diameter of the iris valve assembly 30 is typically larger than the outside diameter of the largest of the collapsible cylinders 16*a*.

As shown in FIG. 2, the center iris valve 30 is canted downward (i.e., concave down) in the preferred embodiment. This design feature increases the pressure holding capacity of the blowout containment device 10. Although it is not intended as a pressure vessel, by design it will withstand nominal overpressure adequate to force the oil through the oil extraction pipes 24 as shown in FIG. 2, and through them to the manifold (not shown, as it is not part of this invention and is normally present during drilling operations). Increasing pressure pushes upward on the iris valve blades from the inside, tightening the grip of the blades on the drill pipe or, if the pipe 24 is absent, this pressure will increase the force with which the ends of the valve blades 32 are pressed together, which action will increase the pressure holding capacity of the blowout containment device 10.

Figure 4:
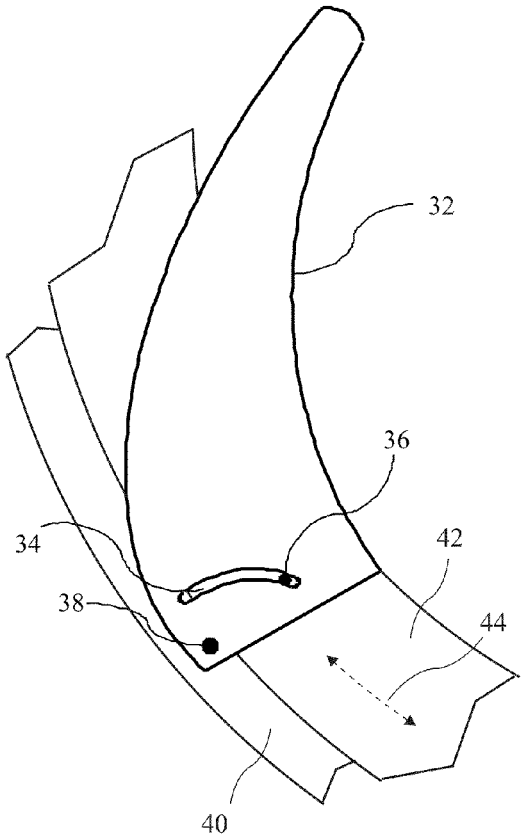
FIG. 4 is a pictorial representation of one iris valve blade showing the pivot axle, the slot in the blade, and the drive pin that rides in the slot.

Several methods of closing the iris valve 30 are contemplated. In the first preferred method a pair of axially co-located rings 40 and 42 (see FIG. 4) serve as both iris valve blade 32 supporting structure and valve closing mechanism. One ring 40 is stationary, the other ring 42 is rotatable as shown conceptually in FIG. 4. The stationary ring 40 contains the blade axles 38, about which the blades 32 pivot. The rotatable ring 42 contains pins 36 that drive each valve blade 32. Each pin 36 slides in a slot 34 in the iris valve blade 32. As the ring 42 with the pins 36 is rotated along arrow 44, the motion of the pin 36 in the slot 34 forces the blade 32 to rotate about the pivot axle 38.

Alternatively, the pins may be fixed in the blades, in which case the pins would slide in slots in the rotatable disc, the rotation of which will cause the blades to move inward toward the closed position when the disc is rotated in one direction, and to move outward toward the open position when the disc is rotated in the opposite direction.

The movable ring may be driven by hydraulic cylinders, or the ring may incorporate gear teeth on the outer periphery which are driven by a hydraulic motor or manually by a shaft that is rotated by a remotely operated underwater vehicle.

While the method of closing the valve described above is preferred, alternative methods are also feasible. Among the alternatives, the one most preferred is the use of hydraulic cylinders to position each blade individually. Various cam and lever arrangements are also obvious alternatives.

Figure 5:
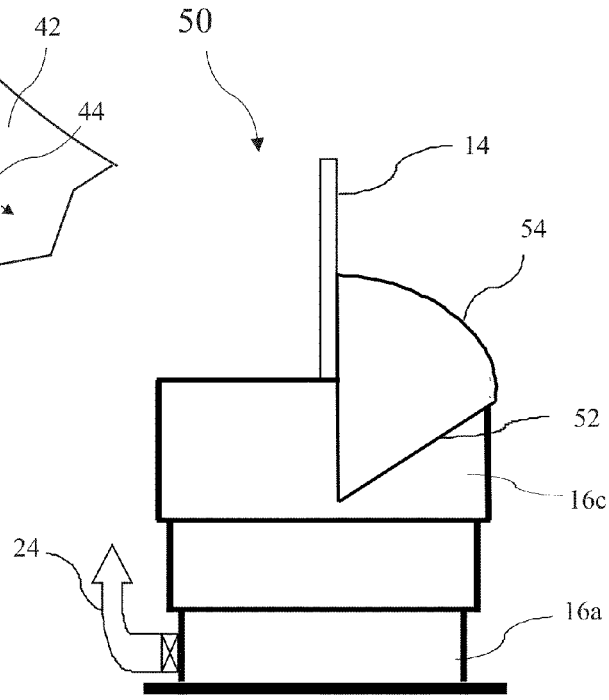
FIG. 5 shows a closure apparatus comprising a clam shell type structure.

An alternative to the iris valve is a clamshell type closure 50 shown in FIG. 5. In this embodiment the inner cylinder 16*a* is stationary and fixed to the base ring, and the outer cylinders 16*b* and 16*c* slide up over one another during deployment. Attached to the outer cylinder 16*c* are a set of shell-like ellipsoidally shaped steel surfaces 54. In FIG. 5, only one shell 54 is shown for clarity. Following full deployment of the cylinders, these shells, which at rest hug the outer periphery of the outer cylinder, glide on angularly oriented tracks 52 attached to the outer cylinder 16*c* and upon full deployment curve up and over the open end of the outer cylinder 16*c*. These shells would be at least two in number, but most preferably four or more.

The shell form can be visualized as a section of a tapered cylinder, akin to the necked-down portion of a water bottle. When this shell is canted at an angle, then a traverse upward from its stowed location on the outside of the outermost cylinder will result in the necked-down portion moving inward over the open cylinder top.

While closure devices 18 comprising an iris device and a clamshell device are described above, a blowout containment device having any closure device is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. An underwater wellhead blowout containment device comprising:

a base;

a family of telescoping cylinders, one of the telescoping cylinders attached to the base, the telescoping cylinders having:

a stored position where the cylinders reside overlapped at the base; and a deployed position where the telescoping cylinders are lifted to form a wall around a Blowout Preventer (BOP) attached to the wellhead, the wall at least as high as the BOP;

a closure device attached to the top of the telescoping cylinders and closeable to capture escaping oil, the closure device having an open position allowing the telescoping cylinders with the closure device attached to be raised around the BOP, and a closed position where the closure device is closed to prevent oil from escaping; and at least one valve for releasing captured oil into at least one corresponding pipe.

2. The underwater wellhead blowout containment device of claim 1, wherein the closure device is an iris device comprising a multitude of overlapping blades, each blade rotating from the open position to the closed position.

3. The underwater wellhead blowout containment device of claim 1, wherein the closure device is a clamshell device attached to an outermost one of the telescoping cylinders, the clamshells comprising shell-like ellipsoidally shaped surfaces.

4. The underwater wellhead blowout containment device of claim 1, wherein:

when a drill pipe is attached to the BOP, the closure device seals around the drill pipe; and in the absence of a drill pipe, the closure device forms a seal over the BOP.

5. The underwater wellhead blowout containment device of claim 2, wherein the iris device has between eight and twenty blades.

6. The underwater wellhead blowout containment device of claim 2, wherein the iris device has about twelve blades.

7. The underwater wellhead blowout containment device of claim 2, wherein in the fully open position, the iris device has an open inner diameter approximately equal to the inner diameter of the smallest of the telescoping cylinders.

8. The underwater wellhead blowout containment device of claim 2, wherein a center of the iris device is canted downward and increasing pressure inside the underwater wellhead blowout containment device pushes upward on the iris device blades from the inside, tightening the seal of the iris device, the pressure increasing the force with which the ends of the blades are pressed together, which increases the pressure holding capacity of the blowout containment device.

9. The underwater wellhead blowout containment device of claim 2, wherein:

the iris device includes co-axially fixed and rotatable rings serving as both iris device blade supporting structure and iris device blade closing mechanism;

the stationary ring establishes blade axles about which the blades pivot; and the rotatable ring includes pins which drive the corresponding blades, each pin slides in a slot in the corresponding blade, and as the rotatable ring is rotated, the motion of the pins in the slots causes the blade to rotate about the blade axle, closing the iris.

10. The underwater wellhead blowout containment device of claim 2, wherein:

the iris device includes co-axially fixed and rotatable rings serving as both iris device blade supporting structure and iris device blade closing mechanism;

the stationary ring establishes blade axles about which the blades pivot; and the blades include pins and the rotating ring includes slots, the pins driven by the corresponding slots, each pin slides in the corresponding slot in the rotating ring and as the rotatable ring is rotated, the motion of the pins in the slots causes the blade to rotate about the blade axle, closing the iris.

11. The underwater wellhead blowout containment device of claim 2, wherein the blades of the iris device are arced blades.

12. The underwater wellhead blowout containment device of claim 2, wherein the blades of the iris device are individually positioned by hydraulic cylinders.

13. The underwater wellhead blowout containment device of claim 1, wherein latched trip to hold the telescoping cylinders in the fully extended position.

14. The underwater wellhead blowout containment device of claim 1, wherein pressure relief valves are attached to the lower most cylinder to limit pressure inside the underwater wellhead blowout containment device.

15. An underwater wellhead and blowout containment device comprising:

a wellhead residing on a sea bed;

a Blowout Preventer (BOP) attached to the wellhead;

a drill pipe extending upward from the BOP;

a base;

a family of telescoping cylinders, one of the telescoping cylinders attached to the base and the family of telescoping cylinders extendable upward to a height above and around the BOP;

an iris closure device attached to the top of the telescoping cylinders and closeable around the drill pipe to capture escaping oil, the iris device comprising a multitude of overlapping blades, each blade pivoting from an open position to a closed position to close the closure device around the drill pipe; and a valve for releasing captured oil into a pipe.

16. An underwater wellhead and blowout containment device comprising:

a wellhead residing on a sea bed;

a Blowout Preventer (BOP) attached to the wellhead;

a drill pipe extending upward from the BOP;

a base resting on the ocean floor;

a family of at least three telescoping cylinders, one of the telescoping cylinders attached to the base and the family of telescoping cylinders extendable upward to a height above and around the BOP;

an iris closure device attached to the top most of the telescoping cylinders and closeable around the drill pipe to capture escaping oil, the iris closure device comprising:

between eight and twenty overlapping arced blades, each blade pivoting from an open position to a closed position to close the closure device around the drill pipe;

co-axially fixed and rotatable rings serving as both iris closure device blade supporting structure and iris closure device blade closing mechanism;

the stationary ring establishes blade axles about which the blades pivot;

the rotatable ring includes pins which drive the corresponding blades, each pin slides in a slot in the corresponding blade, and as the rotatable ring is rotated, the motion of the pins in the slots causes the blade to rotate about the blade axle, closing the iris; and a center of the iris closure device is canted concave downward and increasing pressure inside the underwater wellhead blowout containment device pushes upward on the iris closure device blades from the inside, tightening the seal of the iris closure device, the pressure increasing the force with which the ends of the blades are pressed together, which increases the pressure holding capacity of the blowout containment device;

pressure relief valves are attached to the underwater wellhead blowout containment device to limit pressure inside the underwater wellhead blowout containment device; and a valve for releasing captured oil into a pipe.

* * * * *